US006948250B1

(12) United States Patent
Caiafa, Jr. et al.

(10) Patent No.: US 6,948,250 B1
(45) Date of Patent: Sep. 27, 2005

(54) RETRACTABLE/DISPOSABLE CRAFT KNIFE AND BLADE INSERT THEREFOR

(76) Inventors: Gerard Caiafa, Jr., P.O. Box 888, Vernon, NJ (US) 07462; John R. Ardito, 9 Pennsylvania Blvd., Village of Bellerose, NY (US) 11001

( * ) Notice: Subject to any disclaimer, the term of this patent is extended or adjusted under 35 U.S.C. 154(b) by 0 days.

(21) Appl. No.: 10/382,666

(22) Filed: Mar. 6, 2003

(51) Int. Cl.[7] ..... B26B 1/08
(52) U.S. Cl. ..... 30/162; 30/151; 30/335
(58) Field of Search ..... 30/162, 294, 293, 30/335, 340, 151, 286, 289, 142, 143, 2; 606/167

(56) References Cited

U.S. PATENT DOCUMENTS 4,509,260 A * 4/1985 Gringer ..... 30/162
4,813,143 A 3/1989 Scheminger et al. ..... 16/114
5,330,493 A * 7/1994 Haining ..... 30/151
5,545,175 A * 8/1996 Abidin et al. ..... 30/162
5,599,351 A * 2/1997 Haber et al. ..... 606/167
5,730,751 A * 3/1998 Dillon et al. ..... 30/151
5,933,918 A 8/1999 Wallays ..... 16/114
6,263,577 B1 * 7/2001 Wonderley ..... 30/162
6,374,496 B1 * 4/2002 Hsu ..... 30/162

* cited by examiner

*Primary Examiner*—Stephen Choi
(74) *Attorney, Agent, or Firm*—Siegmar Silber, Esq.

(57) ABSTRACT

A retractable/disposable craft knife with a unitary blade and flexible beam assembly is described. The knife includes an elongated housing which, with the blade and flexible beam assembly inserted therein, holds the assembly under flexural tension. The interior wall of the elongated housing forms a guideway for the unitary blade and flexible beam assembly and provides for the positive alignment of the blade and flexible beam assembly. The blade and flexible beam assembly moves back and forth along the guideway. The craft knife hereof is shown with a safety latch and in another embodiment with a transparent housing. Ergonomics features are discussed.

16 Claims, 5 Drawing Sheets

RETRACTABLE/DISPOSABLE CRAFT KNIFE AND BLADE INSERT THEREFOR

BACKGROUND OF THE INVENTION

1. Field of the Invention

This invention relates to a retractable/disposable craft knife, and, more particularly, to a knife housing into which a unitary blade and flexible beam assembly is readily retracted and from which the assembly is readily extended. Upon exhausting the service life of the blade, the knife is disposable.

2. Description of the Prior Art

Craft knives are used for a multiplicity of purposes and for most effective use the blade must always be sharp. Convenience, safety, economics, and ergonomics all are factors which also are considered in craft knife utilization.

It is convenient to have a craft knife which is both retractable and disposable. While many craft knives have disposable blades few are manufactured sufficiently economically that the entire knife, upon exhausting the service life of the blade, becomes disposable.

In some occupations, craft knives are used repetitively throughout the workday increasing the importance of ergonomic construction. In terms of craft knives, ergonomic design includes a construct that, when naturally held, results in a blade position normal to the cutting plane and one that enables downward pressure to be readily controlled by the user.

Frequently, a craft knife is a household item and, when retractable, carried about in pocket or purse. Thus, safety considerations include a retraction-extension mechanism that has a safety latch, and, when the safety latch is engaged, stays securely sheathed without unexpected or undesired extensions. While the parameter of disposability is of high interest, the within disclosure includes a description of a blade insert or refill blade and beam assembly for the unique product herein described.

In preparing for this disclosure, several patents became known to inventors hereof. By way of background, the patents to Scheminger et al., U.S. Pat. No. 4,813,143 (Original Classification 30/335; issued Mar. 21, 1989); Abidin et al, U.S. Pat. No. 5,545,175 (Original Classification 606/182; issued, Aug. 13, 1996); and, Wallays, U.S. Pat. No. 5,933,018 (Original Classification 16/114R; issued Aug. 10, 1999) are noted.

Scheminger et al. U.S. Pat. No. 4,813,143—The Scheminger et al. patent describes a knife having an adjustable blade length, the tang of which slides into and out of a sliding chamber within the handle thereof. The portion of the handle surrounding the tang is of a resilient deformable material having a high coefficient of friction which, upon being grasped, secures the adjustable blade in the position of use.

Abadin et al., U.S. Pat. No. 5,545,175—The Abidin et al. patent describes a disposable, guarded finger scalpel, the technical advance of which was in response to the need to reduce exposure to the AIDS virus during surgical procedures. Upon squeezing the sides of the scalpel between the thumb and forefinger, a blade is advanced out of an opening. After making an incision, the release of pressure by the user results in the contaminated blade being withdrawn into the scalpel housing. The device of the invention provides a lock-off so that, after use, the contaminated blade is secured within the housing.

Wallays. U.S. Pat. No. 5,933,918—Wallays '918 discloses a multi-use handle for adaptive use with a variety of inserts, which inserts, in turn, serve as a cutting wheel, brush, or scraper. Each implement clips into the forward end of the handle and has a locking component within the receiving chamber of the handle.

These patents are representative of the present state-of-the-art, but do not singly or in combination exhibit the characteristics of the craft knife and insert therefor presented, infra. The citing of the above patents is not intended as an admission that any such patent constitutes prior art against the claims of the present application. Applicant does not waive any right to take any action that would be appropriate to antedate or otherwise remove any listed document as a competent reference against the claims of the present application.

Other technical problems are overcome or resolved by the invention disclosed herein. The innovative approach becomes apparent in the description which follows.

SUMMARY OF THE INVENTION

The present invention is directed to a retractable/disposable craft knife with a unitary blade and flexible beam assembly. The knife includes an elongated housing which, with the blade and flexible beam assembly inserted therein, holds the assembly under flexural tension. The interior wall of the elongated housing forms a guideway for the unitary blade and flexible beam assembly. As the housing of the craft knife has certain asymmetrical characteristics (see infra), the housing provides for the positive alignment of the blade and flexible beam assembly.

The guideway is the interior wall of the elongated housing and leads to an aperture at one end of the elongated body. The aforementioned blade and flexible beam assembly is adapted to move reciprocally back and forth along the guideway. The unitary blade and flexible beam assembly has a slide control portion at one end and a blade portion at the other which are, in turn, connected by an integral beam portion. The slide control portion is flexibly movable toward and away from the longitudinal axis of the housing.

The blade portion has a blade integrally molded into a thermoplastic body at the apertured end of the housing which, upon reciprocal movement, extends beyond the housing and through the aperture and retracts into and fully within the housing. The beam portion acts as a guideway follower, aligns the blade with the aperture during the reciprocal movement, and stops the blade at a work position, at a closed position, and at a safety latched position.

The ergonomic features of the craft knife enhance cutting operation by the user and reduce strain to the hand of the user during repetitive cutting operations. The outside of the housing is designed so that when the craft knife is normally held, that is between the thumb and second finger of the user the extended blade is positioned in a substantially vertical plane. Furthermore, as the craft knife housing has a substantially flat upper surface upon which the first finger of the user rests, this enables downward pressure to be readily applied.

A blade insert for the retractable craft knife of this invention is also described. At times, although, upon the exhaustion of the service life of the blade, the knife is designed to be disposable, the user may opt to replace the blade and beam assembly. The replaceable unit is a blade and flexible beam assembly, as described above, which is insertable into the elongated housing of the craft knife.

OBJECTS AND FEATURES OF THE INVENTION

It is an object of the present invention to provide a craft knife which is a readily retracted and readily extended from the housing thereof.

It is a further object of the present invention to provide a sturdy, yet inexpensive to manufacture, craft knife that, after the service life of the blade has been exhausted, is disposable.

It is yet another object of the present invention to provide a unitary blade and beam assembly that is guided during retraction and extension by the interior wall of the housing.

It is still yet another object of the present invention to provide a craft knife that is ergonomically designed facilitating the application of downward pressure during cutting operations.

It is a feature of the present invention that the unitary blade and beam assembly before insertion in the housing is slightly bowed, and, upon insertion into the housing, is held under flexural tension.

It is another feature of the present invention that the shape of the housing when held normally results in a substantially vertical blade position.

It is yet another feature of the present invention to have a safety latch position to prevent inadvertent extension of the craft knife blade.

It is a still further feature of the present invention to have a stabilizing fin interlocking the housing and the blade holder to minimize the effect of torque exerted upon and transmitted by the blade.

Other objects and features of the invention will become apparent upon review of the drawings and the detailed description which follow. In the drawings, the same parts in the various views are afforded the same reference designators.

DESCRIPTION OF THE PREFERRED EMBODIMENTS

The retractable/disposable craft knife of this invention is designed so that the parts are readily manufacturable by well-known processes, such as injection molding. As these processes yield inexpensive components, after the service life of the blade is exhausted, the final assemblage is disposable. When disposal is not desired, as an alternative, blade and blade holder inserts or refills may be employed. The description below is written to encompass the separate manufacture thereof. The craft knife described hereinbelow has two different embodiments, namely—a retractable/disposable craft knife with a safety lock and a retractable/disposable craft knife, similar to the first embodiment, but with a transparent housing. In the course of describing the first embodiment, the blade and beam insert is described.

Figure 1:
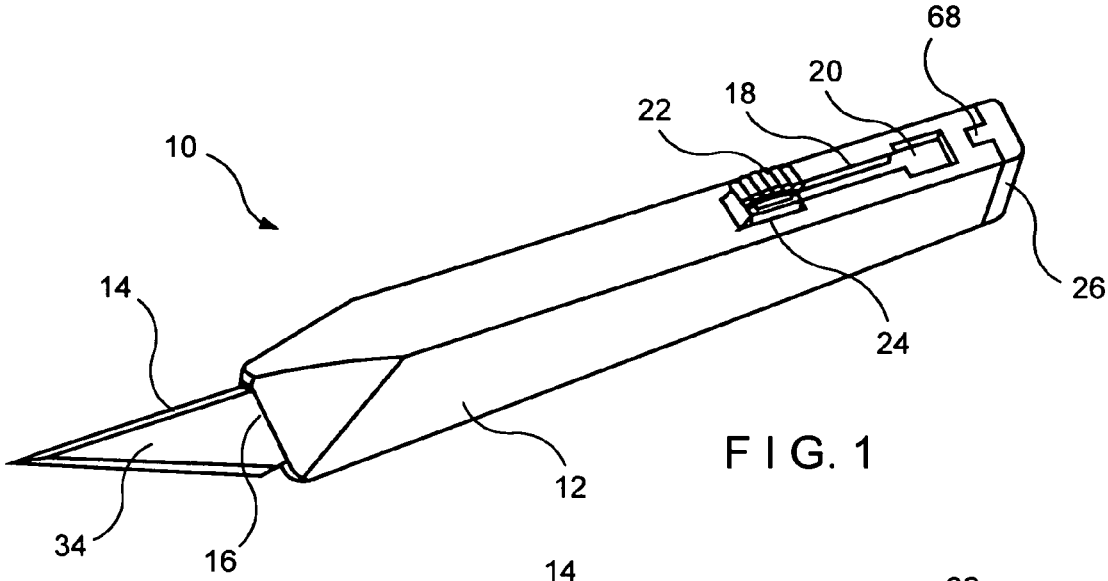
FIG. 1 is a perspective view of the retractable/disposable craft knife and insert therefor of this invention.

In the first embodiment of the present invention, the craft knife, referred to generally by the reference designator 10, is shown in FIGS. 1 through 12. The perspective view, FIG. 1, shows the craft knife in the extended condition. The craft knife 10 is constructed with an elongated housing or sheath 12 and a blade and flexible beam assembly 14. The housing 12 has an aperture 16 in one end of the housing and at the opposite end a slide control access port 18. The access port 18 has two stops, a rear stop or port 20 which is constructed so that when the slide control 22 is moved to coact therewith, the blade and flexible beam assembly 14 is fully retracted into the housing.

Although only two stops are shown, the craft knife of this invention could optionally include one or more additional intermediate stops for varying the amount of extension of the blade and flexible beam assembly 14. The access port 18 further is constructed with a forward stop or port 24, which, when the slide control 22 is moved to coact therewith, the blade and flexible beam assembly 14 is fully extended. The housing 12 includes a cap 26 which encloses the end of the housing adjacent the slide control access port 18.

Figure 2:
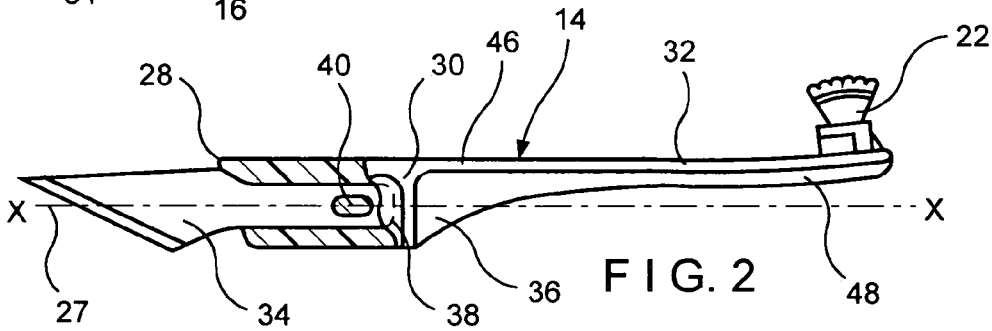
FIG. 2 is a side elevational view of the blade and beam assembly of FIG. 1, partially cut away to show the tang embedded in the assembly.
Figure 3:
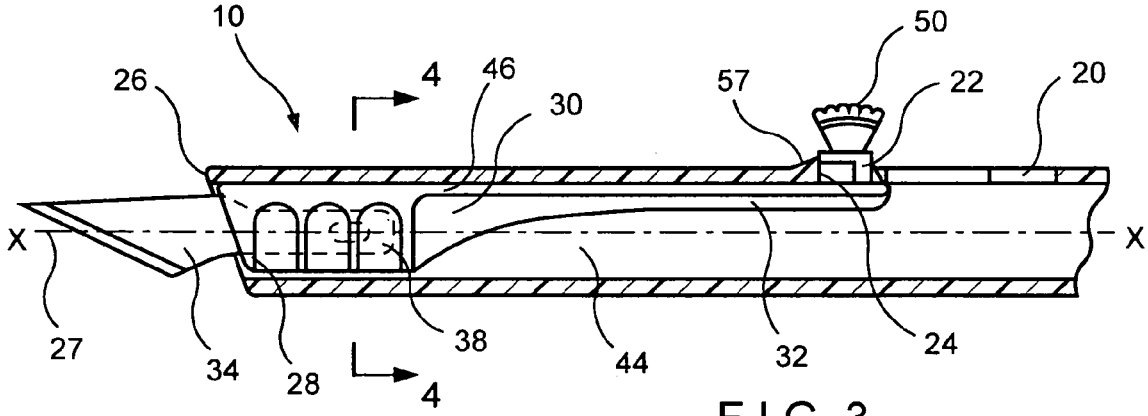
FIG. 3 is a side elevational view of the invention of FIG. 1 with the housing cut away to show the guideway and follower relationship.

Referring now to FIGS. 2 and 3 a side view of the blade and flexible beam assembly 14 and a view of the blade and flexible beam assembly 14 mounted in housing 12 are shown, respectively. In FIG. 2, the uninstalled blade and flexible beam assembly is shown in the relaxed state thereof or in the as-molded condition. Although somewhat exaggerated for graphic presentation, the blade and flexible beam assembly 14 is seen, at the portion thereof containing the slide control 22 to be bowed away from the longitudinal axis 27, line X—X. When the blade and flexible beam assembly 14 is mounted in the housing 12, FIG. 3, the beam is under flexural tension sufficient to substantially straighten the curving or bowing of the beam.

For purposes of the discussion which follows, the blade and flexible beam assembly 14 is considered in three portions, namely, the blade holding portion 28, the guideway follower portion 30, and the slide control portion 32. Although denominated by functionality, there are no boundaries or lines of demarcation defining where one functional portion begins and the other ends. The blade holding portion unitizes the blade 34 into and with the injection molded thermoplastic or reinforced thermoplastic material of the beam 36. The tang 38 of the blade 34 is shown with an opening 40 therethrough enabling the surrounding thermoplastic material, upon being fluid during manufacture, to flow through and securely fix the blade and tang to the assembly.

Variations in the configuration of the tang are well-known in the art and include tangs with bumps, grooves, slits and impressed areas to grip the material in which the blade is mounted. Additionally, while a single blade is shown some cutting and scoring applications require dual, side-by-side mounted blades which blade mounting arrangement can be accommodated by this invention.

Figure 4:
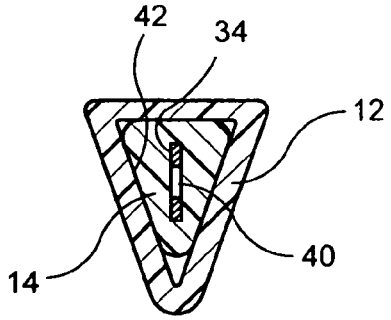
FIG. 4 is a cross-sectional view along line 4—4 of FIG. 3.

With reference to FIGS. 3 and 4, the guideway follower portion 30 is next discussed. Here a portion of the flexible beam 36 is constructed to slidably engage the walls of the interior chamber 42 of the housing 12. These walls form the guideway 44 correspondingly positioned to receive the T-shaped follower 46. In the first embodiment shown here, the guideway 44 is triangular in cross-section, and, more particularly, in the form of an isosceles triangle in cross-section. The upper plate of the T-shaped beam 46 engages the upper portion of the guideway 44.

The housing 12 and the blade and flexible beam assembly 14 are both tapered toward aperture 16 and, upon full extension, nest securely one within the other. This shape ensures that the blade 34 is in true alignment with aperture 16. While the cross-sectional shape of the isosceles triangle is employed in this embodiment, any asymmetrical guideway suffices that prevents rotation of the blade 34 and maintains alignment with the aperture 16. Other symmetrical shapes would permit unaligned insertions of the blade and flexible beam assembly 14 into housing 12 and, thus, the top-to-bottom asymmetry of this application is preferred. The nesting arrangement prevents the transmission of twisting or torque-like forces from the cutting blade to the interior of the knife.

The slide control portion 32 of the preferred embodiment consists of a flexible member 48 with a slide control 22 molded thereonto. As described above, the state of the blade and flexible beam assembly 14, as installed, is under flexural tension and is biased toward achieving the normal relaxed state shown in FIG. 2. The flexible member 48 is constructed, during extension and retraction, to be further flexed toward line X—X. The assembly 14 is constructed to provide reciprocal movement on two levels best seen in FIGS. 7 and 11 in which the craft knife 10 is viewed with end cap 26 removed. Upon flexing the flexible member 48, energy is stored therein.

Figure 5:
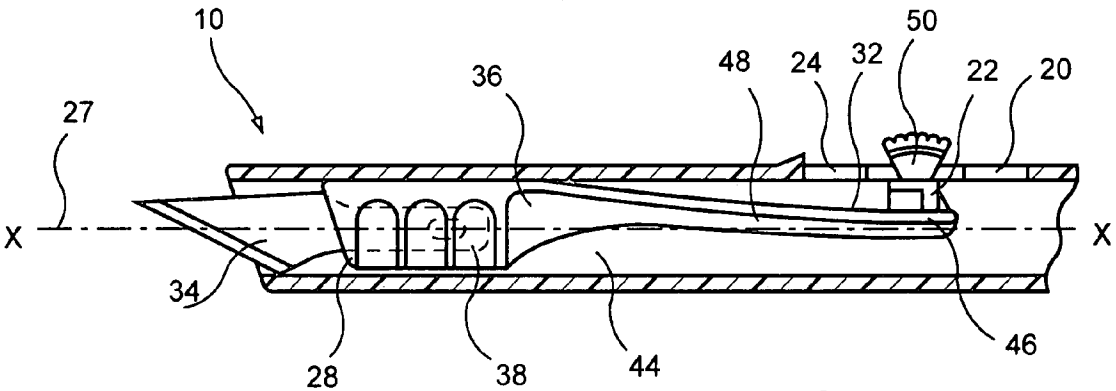
FIG. 5 is a side elevational cut away view of the retractable/disposable craft knife of this invention shown in the extension/retraction mode.
Figure 7:
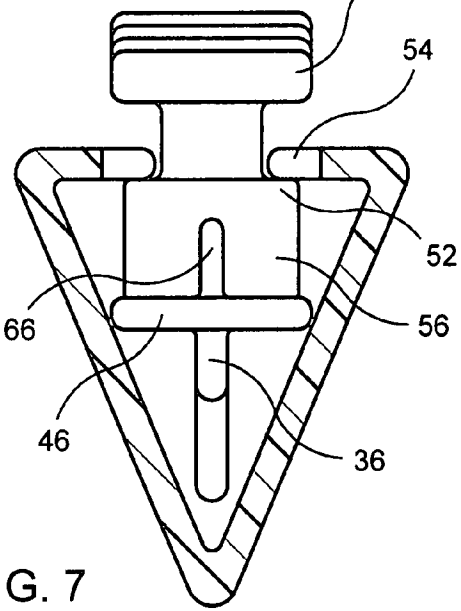
FIG. 7 is an end view of the retractable/disposable craft knife of FIG. 5 with the end cap removed as seen during extension/retraction mode.
Figure 6:
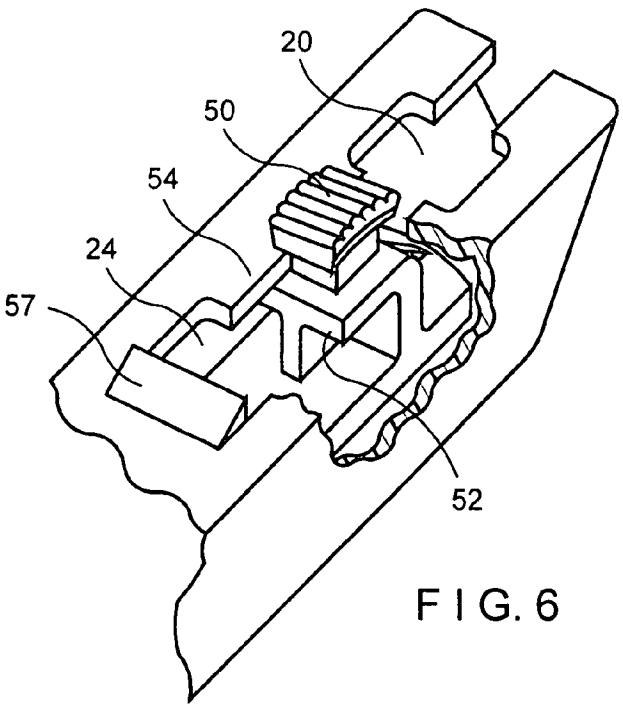
FIG. 6 is a partial perspective view of the retractable/disposable craft knife of this invention with the housing cut away to show the position of the control device during the extension/retraction mode.
Figure 8:
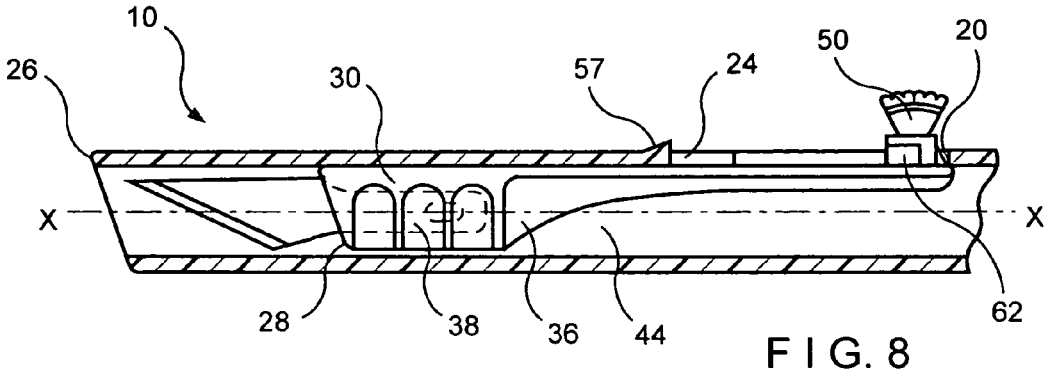
FIG. 8 is a side elevational view of the retractable/disposable craft knife of this invention with the housing cut away to show the retracted craft knife with the safety lock disengaged.
Figure 9:
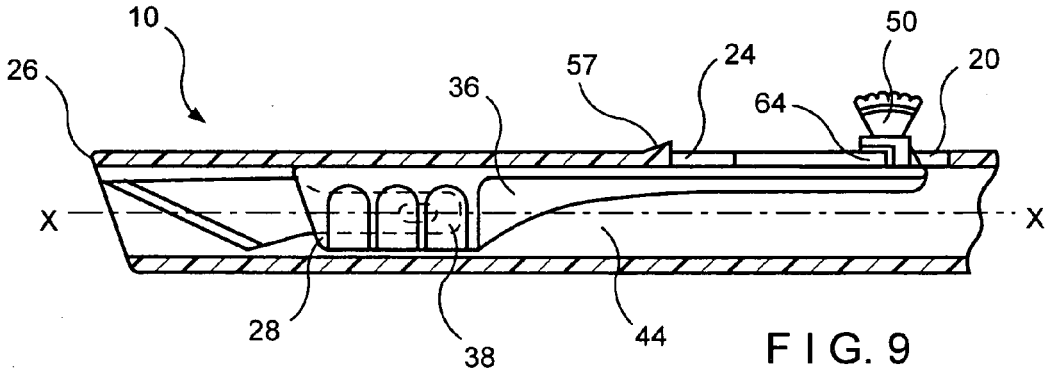
FIG. 9 is a side elevational view of the retractable/disposable craft knife of this invention with the housing cut away to show the retracted craft knife with the safety lock engaged.
Figure 10:
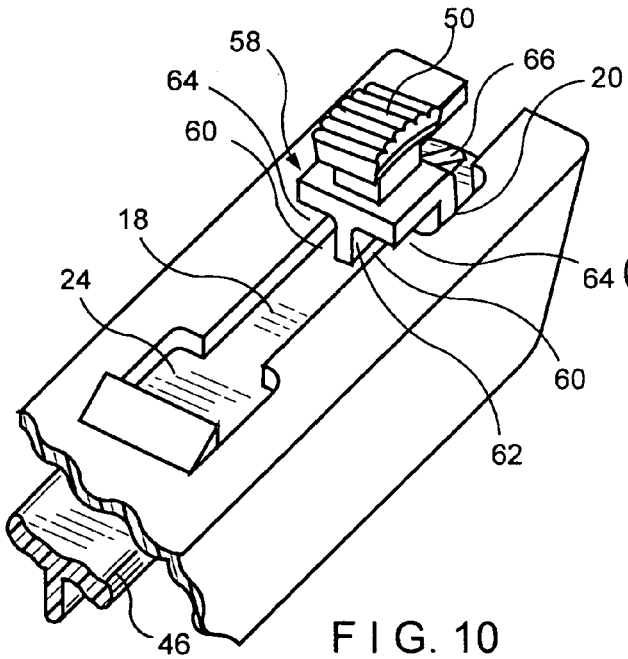
FIG. 10 is a partial perspective view of the retractable/disposable craft knife of this invention showing the safety latch engaged.
Figure 11:
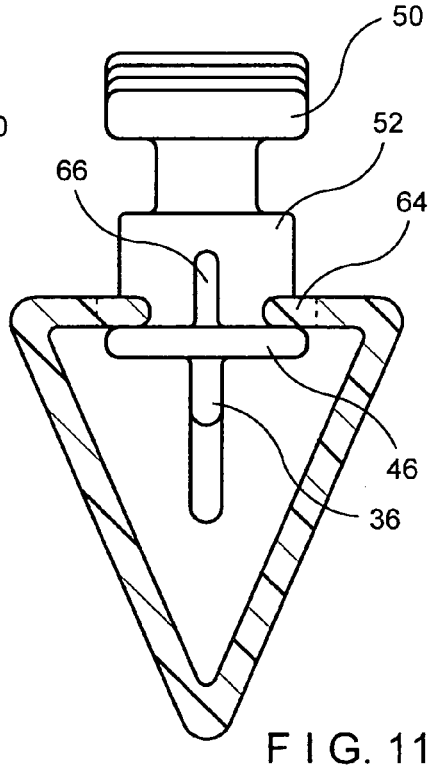
FIG. 11 is an end view of the retractable/disposable craft knife of FIGS. 8 and 9 with the end cap removed as seen during the working and safety latching modes.

Referring now to FIGS. 5 through 7, views of the slide control portion 32 are shown. In these figures, the slide control portion 32 is shown in the extension/retraction mode. During reciprocal motion between ports 20 and 24, the slide control knob 50 is depressed so that the anterior portion of the beam 36 rides, low in the housing 12. In the travel between rear port 20 and forward port 24, the flexible beam 36 is held down by shoulder 52 of control knob 50 coacting with the lip 54 of slide control access port 18.

Upon reaching either port 20 or 24, the flexural tension urges the beam toward the relaxed condition and the lower body 56 of the control knob 50 is raised or pops up into the respective port. The popping up of control knob 50 is the recovery of stored energy by the elastic return of the bent flexible member 48. The control knob 50 is designed to have a footprint that closely approximates the opening of the ports 20 and 24 and, upon being raised into one of the ports is closely fitted therewithin.

In FIGS. 3 and 8 through 11, the slide control portion 32 is shown in the raised condition. When raised in the forward port 24, the craft knife 10 has the blade fully extended and control knob 50 rests against bumper 57. Here, the craft knife is in the working mode. Because of the footprint/port relationship there is little endplay when the slide control portion is in the raised condition at the forward port 24.

In FIGS. 8 through 11, the details of safety latch 58 of control knob 50 is shown. When raised in the rear port 20, the craft knife has the blade fully retracted and is in the portative mode. At this level, the blade and flexible beam assembly 14 is reciprocally movable to engage and disengage a safety latch feature. The control knob 50 has openings 60 on either side of front vane 62 and, with the slide control portion 32 raised, is slidable forward and back to engage and disengage the front rim 64 of rear port 20. Rear vane 66 is constructed to urge the blade and flexible beam assembly 14 forward upon contacting finger 68 of cap 26. Because of the footprint/port relationship there is little endplay when the slide control portion is in the raised condition at the rear port 20.

The reciprocal movement to engage and disengage the safety latch 58 is a positive, but slight, movement of no more than ⅛-inch. The engagement movement slides the blade 34 forward toward aperture 16, but with the blade remaining within housing 12. The disengagement movement slides the blade rearward toward cap 26, but remaining within housing 12 and places the entire control knob 50 within the opening of rear port 20.

Figure 12:
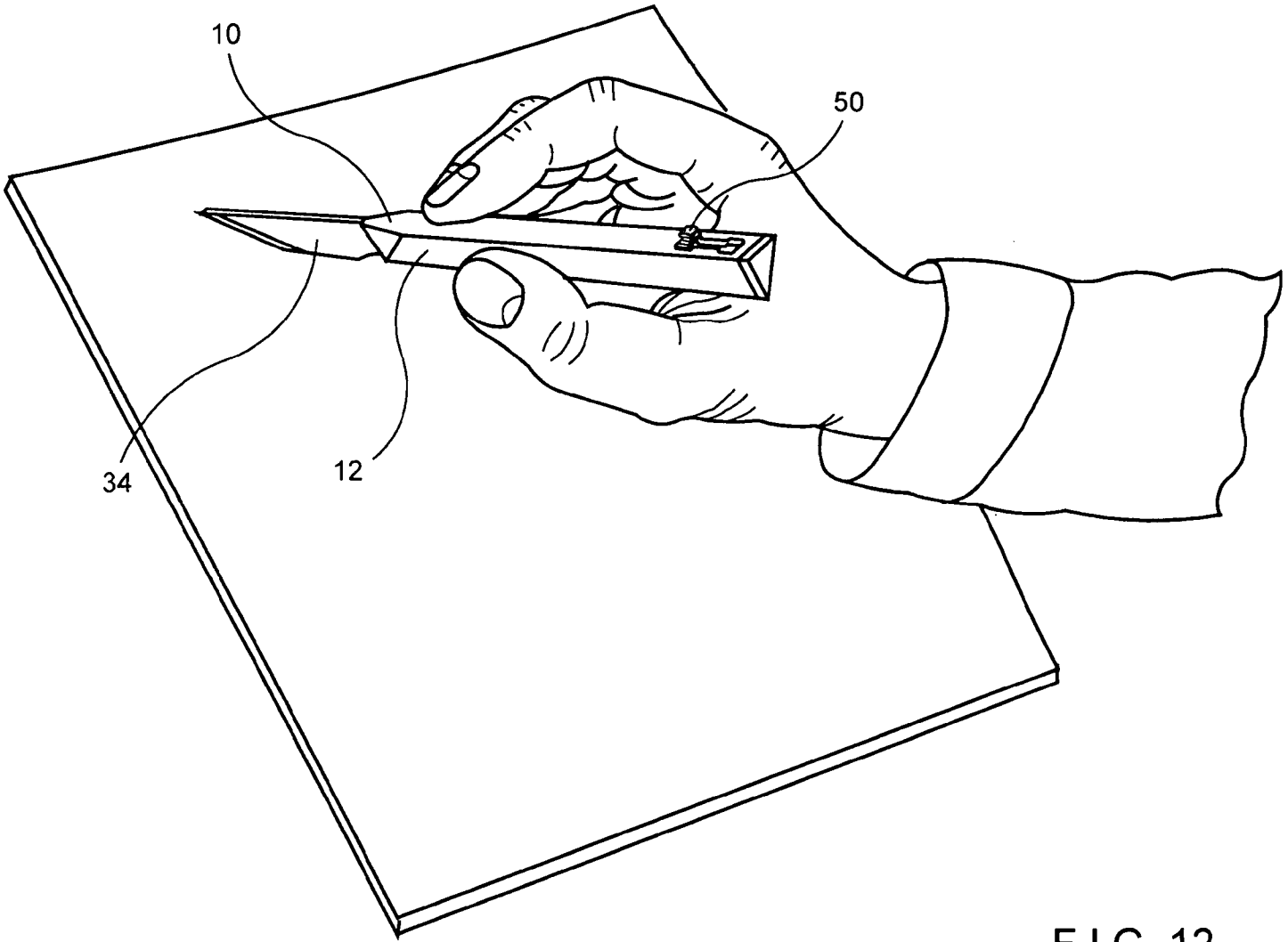
FIG. 12 is a view of the retractable/disposable craft knife of this invention held by the user and showing the ergonomic features thereof.

Referring now to FIG. 12, the ergonomic aspect of the first embodiment is next discussed. In holding a pen or other similar type implement in one's hand the thumb and second finger cradle the shaft or the barrel of the pen and the first finger is on top of the barrel holding the pen in position. With the craft knife of this invention, the same relationship pertains; however, in this case, it is preferred to have the blade normal to the cutting surface. The cross-sectional shape, seen in FIG. 4, is analogous to that formed by the second finger, the thumb and the first finger if the pen were to be removed. Thus, to maintain the blade normal to the cutting surface, the lower angle or the apex angle of the isosceles triangle of the housing 12 is approximately 50° (with the remaining interior angles being approximately 65°). The flat top of the craft knife housing permits the user to apply a controlled and gentle downward pressure to the knife.

From the foregoing, it is seen that the disposability of the craft knife of this invention is enhanced by several factors, namely: (1) reducing the number of parts to be manufactured; (2) ensuring each part is simple and economic to manufacture; and, (3) minimizing assembly procedures. In the embodiment shown, there are three parts—a housing; a blade and flexible beam assembly; and, a cap. All three are structured so as to be manufactured by injection molding techniques permitting high quantities at low unit cost. With regard to manufacturing processes, the methods for unitizing the blade into the flexible beam are well known. The thermoplastic materials are inexpensive and are selected to provide optimum lubricity so as to enable the sliding of the parts during extension and retraction without undue friction therebetween. To assemble the craft knife, the cap is removed from the housing, the blade and flexible beam assembly is inserted into the guideway (while flexing the assembly toward the longitudinal axis of the housing), and the cap is replaced. In the structure described herein, the disclosed devices meet all the criteria of the disposability factors initially set forth above.

When disposal of the craft knife is not desired the structure is simple enough to remove the cap, discard the spent blade and beam insert, replace the same with a refill unit as shown in FIG. 2, and replace the cap. The craft knife is sufficiently simple for this to be accomplished by the user. Upon replacement, as the tang of the blade is unitized with the beam, clamping of the new blade to the handle is not required as it is with most present-day craft knives.

Figure 13:
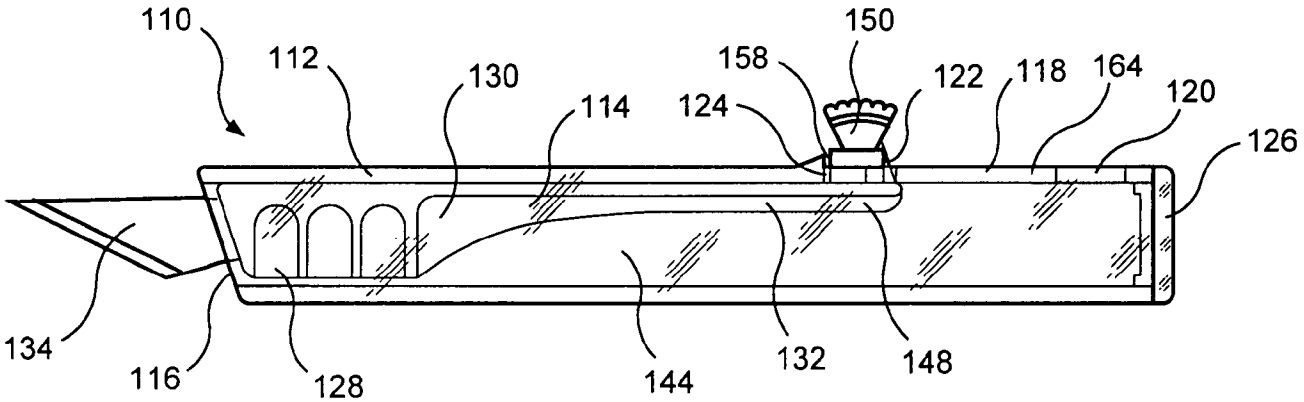
FIG. 13 is a side elevational view of the second embodiment, similar to FIG. 1 with the housing constructed from transparent thermoplastic material with the craft knife shown in the fully extended position.
Figure 14:
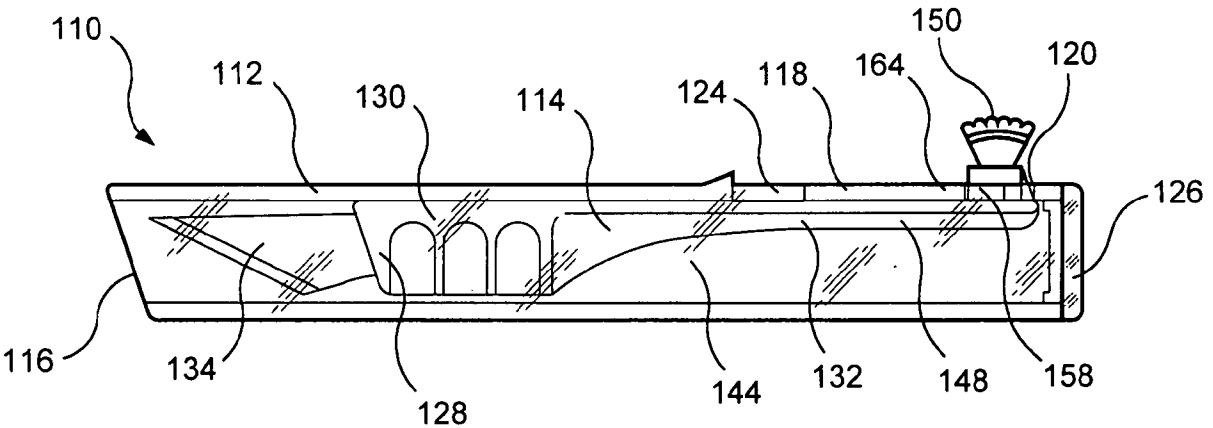
FIG. 14 is another side elevational view of the craft knife of FIG. 13, but shown with the blade and flexible beam assembly in the retracted position.

In the second embodiment of the present invention, the craft knife is referred to generally by the reference numeral 110 and is shown in FIGS. 13 and 14. In this embodiment reference numerals "100" higher than those in the first embodiment are used with similar components having similar references, for example, the housing in the first embodiment is referred to by the numeral 12; and, in this embodiment, by the numeral 112.

In the second embodiment of the present invention, the craft knife 110 uses the same blade and flexible beam assembly as in the first embodiment and has a transparent housing 112. The transparent housing 112 adds an additional safety feature to the construct by providing the user with a visual indication of the position of the blade and flexible beam assembly 114 relative to aperture 116.

As in the first embodiment, the access port 118 has a rear stop 120 and, when the slide control 122 is aligned therewith, the blade and flexible beam assembly 114 is fully retracted. The access port 118 also has a forward stop 124 which, when the slide control 122 is aligned therewith, the knife is fully extended. The housing 112 includes a cap 126 adjacent to access port 118.

The blade and flexible beam assembly or blade and beam insert 114 has three functional aspects, namely, the blade holding portion 128 unitizing the blade 134 and the thermoplastic material; the guideway follower portion 130 controlling the alignment of the assembly with aperture 116 in guideway 144; and, the slide control portion 132 governing the extension/retraction of the craft knife. As in the first embodiment, the T-shaped follower 146 has at the end opposite the blade 134 a flexible member 148 which is operated by control knob 150 to the extended, retracted or latched positions. With the transparent housing 112, the user can visually monitor the safety catch 158 at the front rim 164 of rear port 120.

Novel features which are believed to be characteristic of the invention are set forth with particularity in the appended claims. For a full understanding of the invention, reference should be made to the above detailed description taken in conjunction with the accompanying drawings, by which it will be seen that the objects set forth above and made apparent from the preceding description are efficiently attained. Because many varying and different embodiments may be made within the scope to the inventive concept taught herein and, in accordance with the descriptive requirement of the law, because many modifications may be made to the embodiments herein, it is to be understood that the details herein are to be interpreted as illustrative and not in a limiting sense.

What is claimed is:

1. A disposable craft knife comprising, in combination:

a housing having an elongated body and forming a guideway therewithin, said guideway disposed about the longitudinal axis of said housing, said housing, in turn, comprising;

an aperture in one end of said elongated body;

a blade and flexible beam assembly disposed in said housing and adapted for reciprocal movement along said guideway, said blade and flexible beam assembly tapered toward said aperture and, adapted with the blade fully extended, to nest securely within a tapered portion of said housing, said blade and flexible beam assembly, during cutting operations, being nonrotatably held within said housing and precluding transmission of forces from the cutting blade to the interior of the knife, said blade and flexible beam assembly, in turn, comprising:

a body formed from a thermoplastic material;

a slide control portion at one end of said body, said slide control portion, upon flexing said blade and flexible beam assembly, being movable toward and away from said longitudinal axis of said housing;

said housing further comprising;

said tapered portion of said housing transversely tapered toward said aperture in relation to the longitudinal axis of said blade and flexible beam assembly;

a blade portion with a blade integrally molded into said thermoplastic material at the end opposite said slide control portion;

a beam portion extending between and integral with said blade portion and said slide control portion, said beam portion following said guideway during said reciprocal movement between an extended position and a retracted position; and, said blade portion, upon reciprocal movement, extending beyond said housing through said aperture thereof to an extended position and retracting into and fully within said housing to a retracted position.

2. A disposable craft knife as described in claim 1 wherein said blade and flexible beam assembly is a bowed structure and, when disposed in said housing, said thermoplastic material thereof is under flexural tension with the longitudinal axis substantially parallel to said longitudinal axis of said housing.

3. A disposable craft knife as described in claim 2 wherein said housing is formed from a transparent thermoplastic material whereby the user of said disposable craft knife has the added safety of visually ascertaining the position of said blade portion relative to said aperture.

4. A disposable craft knife as described in claim 2, wherein said housing further comprises:

a rear port for receiving, at said retracted position, said slide control portion therethrough and, upon said slide control portion being positioned thereunder, said slide control being urged therethrough by relaxation of flexural tension in said thermoplastic material.

5. A disposable craft knife as described in claim 4, wherein said housing further comprises:

a forward port for receiving, at said extended position, said slide control portion therethrough and, upon said slide control portion being positioned thereunder, said slide control portion being urged therethrough by relaxation of flexural tension in said thermoplastic material.

6. A disposable craft knife as described in claim 5 wherein said housing further comprises:

a control slot providing communication between said rear port and said forward port, said control slot coacting with said slide control portion during said reciprocal movement thereof.

7. A disposable craft knife as described in claim 6 wherein said rear port and said slide control portion coact to provide a safety lock with said blade in a retracted position, said safety lock, upon engagement thereof, precluding reciprocal movement to an extended position.

8. A disposable craft knife as described in claim 1 wherein the surfaces of said blade portion are dimensioned to slidingly engage the surfaces of said guideway and to align said blade with said aperture.

9. A disposable craft knife as described in claim 8 wherein said beam portion being T-shaped in cross section with an upper plate thereof engaging the upper portion of said guideway.

10. A disposable craft knife as described in claim 8, wherein said beam portion has the same cross-sectional shape as the housing but reduced to telescope therewithin.

11. An ergonomic craft knife with features enhancing cutting operation by a user and reducing strain to the hand of the user during said cutting operation, said ergonomic craft knife comprising:

a blade;

a housing with an elongated body forming a guideway therewithin and, when viewed in the operating position, said housing having a substantially flat upper surface, said guideway disposed about the longitudinal axis of said housing;

an aperture in one end of said elongated body, said guideway of said housing terminating in an asymmetric concavity about said aperture;

a control slot in said housing adjacent the end opposite said aperture;

a blade holder and flexible beam assembly adapted for reciprocal movement back and forth along said guideway, said blade holder and flexible beam assembly of molded thermoplastic material, in turn, comprising;

a slide control portion at one end thereof, said slide control portion reciprocally operative within said control slot and flexibly moveable toward and away from the longitudinal axis of said housing;

a blade holder portion with said blade integrally molded thereinto at the end opposite said slide control portion said blade holder holding said blade substantially normal to said upper surface of said housing, said blade holder portion, when fully extended, dimensioned to nest within said asymmetric concavity of said guideway;

a beam portion extending between and integral with said blade portion and said slide control portion, said beam portion slidingly engaging the surface of said guideway during said reciprocal movement, said beam portion being a bowed structure and, when mounted in the housing, being under flexural tension with the longitudinal axis thereof aligned with the longitudinal axis of said housing; and, said blade, upon reciprocal movement, adapted to extend said blade beyond said housing through said aperture thereof and to retract into and fully within said housing;

whereby the ergonomic craft knife, during cutting operation, is adapted to be held between the thumb and second finger of said user with said flat upper surface of said housing under the first finger of said user, positioning the blade in a substantially vertical plane and enabling said user to readily apply downward pressure to the blade.

12. An ergonomic craft knife as described in claim 11 wherein said housing is formed from a transparent thermoplastic material whereby the user of said ergonomic craft knife has the added safety of visually ascertaining the position of said blade portion relative to said aperture.

13. An ergonomic craft knife as described in claim 11 wherein said beam portion being T-shaped in cross section with an upper plate thereof engaging the upper portion of said guideway.

14. An ergonomic craft knife as described in claim 13 wherein the surfaces of said beam portion are dimensioned to slidingly engage the surfaces of said guideway to minimize transmission of torque exerted upon said blade.

15. An ergonomic craft knife as described in claim 11 wherein said beam portion has the same cross-sectional profile as the housing but reduced in size to telescope therewithin.

16. An ergonomic craft knife as described in claim 11 wherein said control slot further comprises:

at least two ports for coaction with said slide control portion, each of said ports limiting the extension of said blade.

* * * * *